US008081074B2

(12) United States Patent
Marshall et al.

(10) Patent No.: US 8,081,074 B2
(45) Date of Patent: Dec. 20, 2011

(54) SECURITY SYSTEM FOR PROTECTING CONSTRUCTION SITE ASSETS

(76) Inventors: Jack L. Marshall, Harvest, AL (US); John Allen Burnham, Madison, AL (US); Rodney L. Weaver, Huntsville, AL (US); Ronald E. Smith, Laceys Spring, AL (US); William T. Powers, Taft, TN (US)

( * ) Notice: Subject to any disclaimer, the term of this patent is extended or adjusted under 35 U.S.C. 154(b) by 468 days.

(21) Appl. No.: 12/208,958

(22) Filed: Sep. 11, 2008

(65) Prior Publication Data

US 2009/0066526 A1 Mar. 12, 2009

Related U.S. Application Data

(60) Provisional application No. 60/993,269, filed on Sep. 11, 2007.

(51) Int. Cl.
*G08B 13/12* (2006.01)

(52) U.S. Cl. ..... 340/568.2; 340/568.1; 340/568.3; 340/545.2; 340/635

(58) Field of Classification Search ..... 340/568.2, 340/568.1, 582.3, 687, 545.2, 635
See application file for complete search history.

(56) References Cited

U.S. PATENT DOCUMENTS

| | | | | |
|---|---|---|---|---|
| 4,032,916 | A | | 6/1977 | Galvin et al. |
| 4,321,592 | A | | 3/1982 | Crandall et al. |
| 4,746,909 | A | | 5/1988 | Israel et al. |
| 5,025,653 | A | | 6/1991 | Schuldt |
| 5,463,595 | A | * | 10/1995 | Rodhall et al. ..... 367/93 |
| 5,517,175 | A | | 5/1996 | Brown et al. |
| 5,543,782 | A | | 8/1996 | Rothbaum et al. |
| 5,561,417 | A | | 10/1996 | Rothbaum et al. |
| 5,774,044 | A | * | 6/1998 | Hayashi ..... 340/426.1 |
| 5,959,528 | A | | 9/1999 | Right et al. |
| 6,104,289 | A | | 8/2000 | Rand |
| 6,182,497 | B1 | | 2/2001 | Krajci |
| 6,278,365 | B1 | | 8/2001 | Kane et al. |
| 6,288,640 | B1 | | 9/2001 | Gagnon |
| 6,690,277 | B1 | | 2/2004 | Hansen et al. |
| 6,897,772 | B1 | | 5/2005 | Scheffler et al. |
| 6,952,166 | B2 | | 10/2005 | Lee |
| 6,989,747 | B2 | * | 1/2006 | Konecnik ..... 340/568.2 |
| 7,187,284 | B2 | | 3/2007 | Masciantonio |

FOREIGN PATENT DOCUMENTS

GB 2297410 A 7/1996

* cited by examiner

*Primary Examiner* — Jennifer Mehmood
*Assistant Examiner* — Hongmin Fan
(74) *Attorney, Agent, or Firm* — George P. Kobler; Lanier Ford Shaver & Payne, P.C.

(57) ABSTRACT

An apparatus for deterring removal of electrical wiring that is installed in a building includes a controller, and a wiring module responsive to the controller and forming a monitored circuit with installed electrical wiring by coupling to an end of the wiring located at a load distribution junction. The other end of the wiring is electrically coupled, and can be coupled with a controlled impedance, or with a protected asset. The apparatus is configured with control logic to issue an alert if the integrity of the monitored circuit has been compromised.

14 Claims, 7 Drawing Sheets

SECURITY SYSTEM FOR PROTECTING CONSTRUCTION SITE ASSETS

CROSS-REFERENCE TO RELATED APPLICATIONS

Pursuant to 35 U.S.C. §119, priority is claimed to U.S. Provisional App. Ser. No. 60/993,269, filed Sep. 11, 2007, and which is incorporated by reference as if fully set forth herein.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

Figure 1:
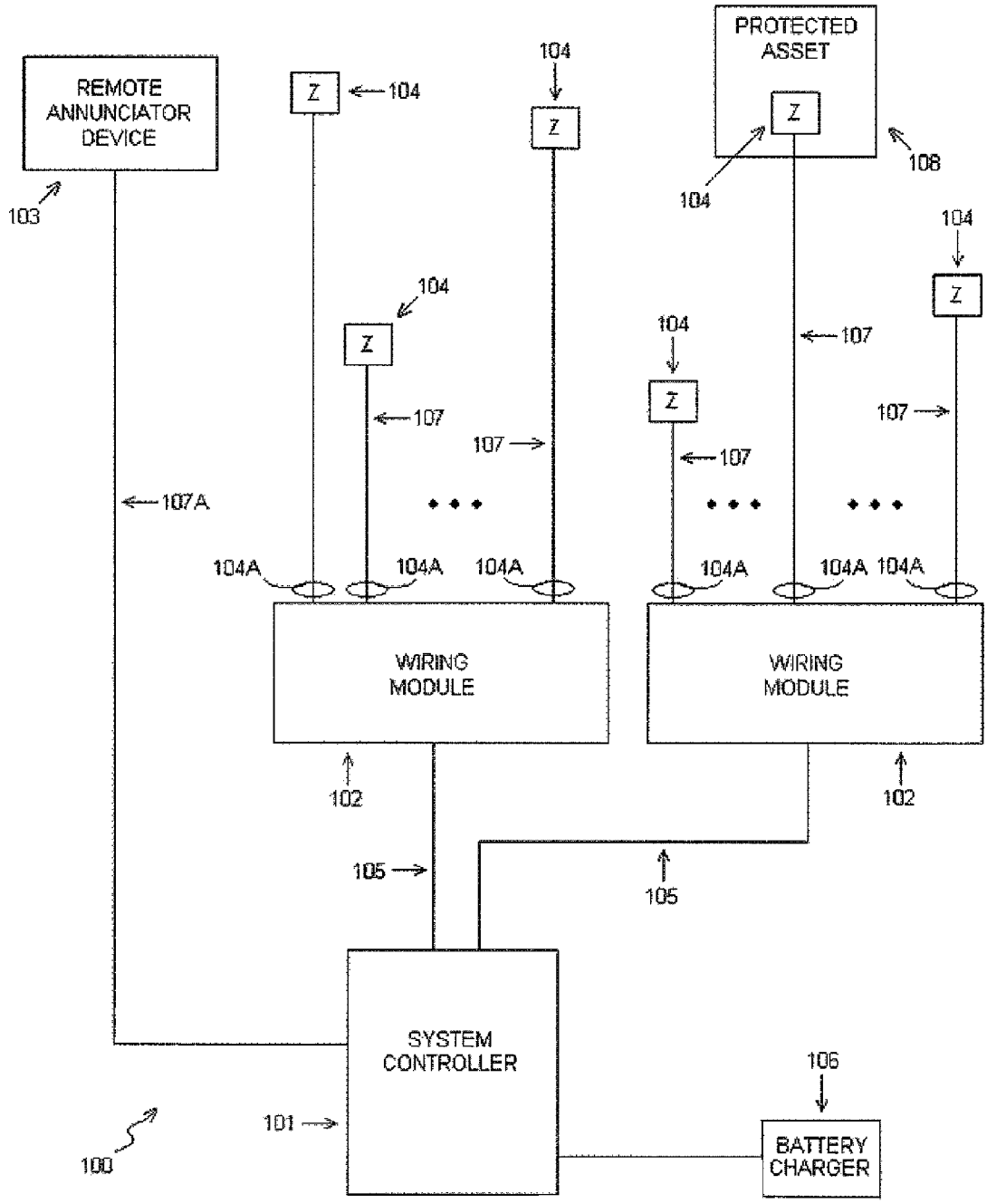
FIG. 1 is a functional schematic of an exemplary security system apparatus as claimed hereinbelow.

The various embodiments of the present invention and their advantages are best understood by referring to FIGS. 1 through 7 of the drawings. The elements of the drawings are not necessarily to scale, emphasis instead being placed upon clearly illustrating the principles of the invention. Throughout the drawings, like numerals are used for like and corresponding parts of the various drawings.

The drawings represent and illustrate examples of the various embodiments of the invention, and not a limitation thereof It will be apparent to those skilled in the art that various modifications and variations can be made in the present inventions without departing from the scope and spirit of the invention as described herein. For instance, features illustrated or described as part of one embodiment can be included in another embodiment to yield a still further embodiment. Moreover, variations in selection of materials and/or characteristics may be practiced to satisfy particular desired user criteria. Thus, it is intended that the present invention covers such modifications as come within the scope of the features and their equivalents.

Furthermore, reference in the specification to "an embodiment," "one embodiment," "various embodiments," or any variant thereof means that a particular feature or aspect of the invention described in conjunction with the particular embodiment is included in one or more embodiments of the present invention. Thus, the appearance of the phrases "in one embodiment," "in another embodiment," or variations thereof in various places throughout the specification does not necessarily limit the implementation of a described feature to a particular embodiment.

An exemplary security system 100 which achieves the purposes of the invention claimed below is designed to provide theft protection of unpowered electrical wiring 107 installed in construction sites or unoccupied buildings. Electrical wiring 107 is understood to be a length of two or more conductors that will form a circuit when fully installed and powered. The system uses the rough-installed electrical wiring being protected as an integral part of the system. The system structure is designed to be inexpensive to manufacture and require minimal labor to install and maintain, without impacting standard construction practices. The wiring module 102 couples to the ends of the electrical wiring 107 installed in a standard load distribution junction 311, or circuit breaker panel, such ends referred to hereinafter as the "near ends." The system controller 101 controls function and manages power to one or more wiring modules to accommodate sites having more than one load distribution junction. The system 100 preferably uses a controlled impedance device 104 coupled to the distal ends of the installed wiring 107 to create a circuit and to circumvent attempts to defeat the alarm system at the wiring module(s) 102, eliminating the need to ruggedize all of the system elements. The system 100 is designed to be self-powered to accommodate sites where power may not be available. The internal batteries 403 may be recharged in the system with an optional charger 106, or be removed by the user for replacement or off site recharging. The system 100 may be used to protect assets 108 other than installed electrical wiring 107, such as uninstalled bulk wiring, devices with electric motors, or electric appliances that are within reach of electrical wiring on the premises. The system will alert individuals in the vicinity of a tamper or theft violation with a loud audible siren.

Figure 4:
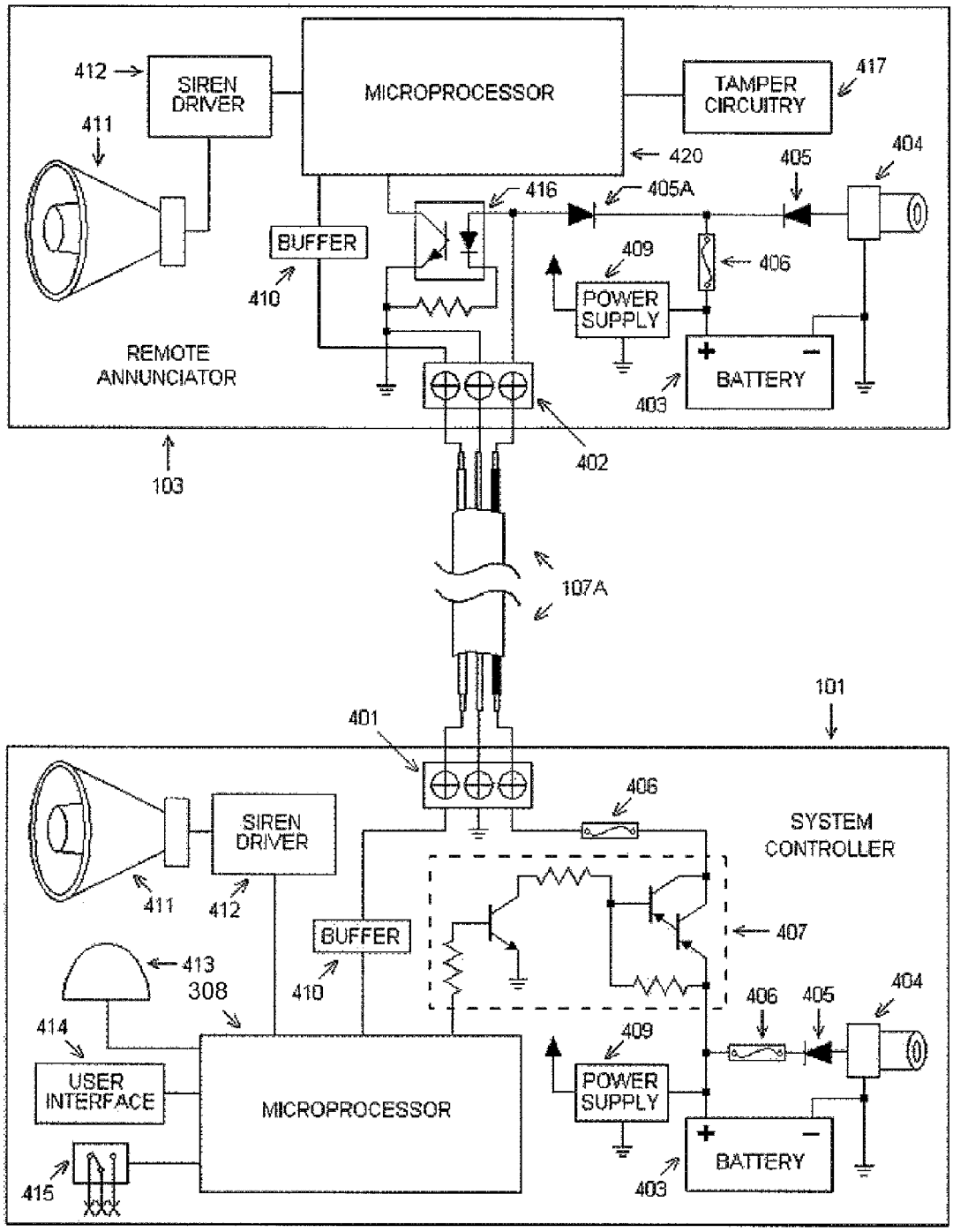
FIG. 4 is a functional schematic of another exemplary embodiment of a security system as claimed hereinbelow.

With reference to FIG. 4, a system controller 101 may comprise a processor, or microprocessor 308, which is configured with control logic to execute the control functions as described in greater detail below. The primary function of the system controller 101 is to provide the command, control and user interface for the system 100. Microprocessor 308 is coupled to an audible siren device 411 through a siren driver circuit 412, and is also coupled to a visible armed indicator lamp 413. A user interface 414, which may be, without limitation, a keypad, touchscreen, or other input device known in the art, is included for user input and is also configured to provide system status indications to the user. Power for the microprocessor 308 and other devices is supplied by the power supply circuit 409 coupled to battery 403 which may be a replaceable rechargeable battery. If a recharging battery is implemented, system controller 101 may include charger connector 404 which supplies current to the battery through a polarity protection diode 405 and an over current protection fuse 406.

The microprocessor 308 also may be coupled to an auxiliary alarm status output 415 which allows the connection of optional user supplied accessories that can react to an alarm state. The auxiliary status output 415 may be implemented with a conventional single-pole, double throw (SPDT) switch coupled to terminals which may be connected to devices which, when appropriate predetermined conditions exist, may throw the switch to couple a signal indicative of status to an external device to establish a communications though a distributed communications network (not shown) with a remote communications device (also not shown) such as a cell phone, a pager, an email device, or the like. In this manner, system status may be communicated to a remote user.

The wiring module 102 provides interconnection between the system controller 101 to one or more lengths of electrical wiring 107 previously installed on the premises. Each length of wiring 107 is connected to a unique terminal on the wiring module 102 and is terminated on the far end with a controlled impedance device 104. The wiring module 102 contains the logic necessary to determine which terminals are presented with the proper controlled impedance 104A and which terminal(s) are presented with an impedance that exceeds the acceptable limits of the controlled impedance 104A. On command from user input the wiring module 102 will display by way of light emitting diodes (LEDs) which terminal(s) are presented with the proper controlled impedance 104A and will display which terminal(s) that were previously identified as being presented with the proper impedance 104A exceeded the acceptable limits during a previous armed state of the alarm system 100. In the embodiment shown in FIG. 1, the wiring module(s) 102 connect to the system controller 101 by way of the wiring module interconnect cable(s) 105. It will be appreciated, however, that wiring module(s) 102 may be one or more structures co-located with the structure performing the functions of system controller 101 within a common housing.

Figure 2A:
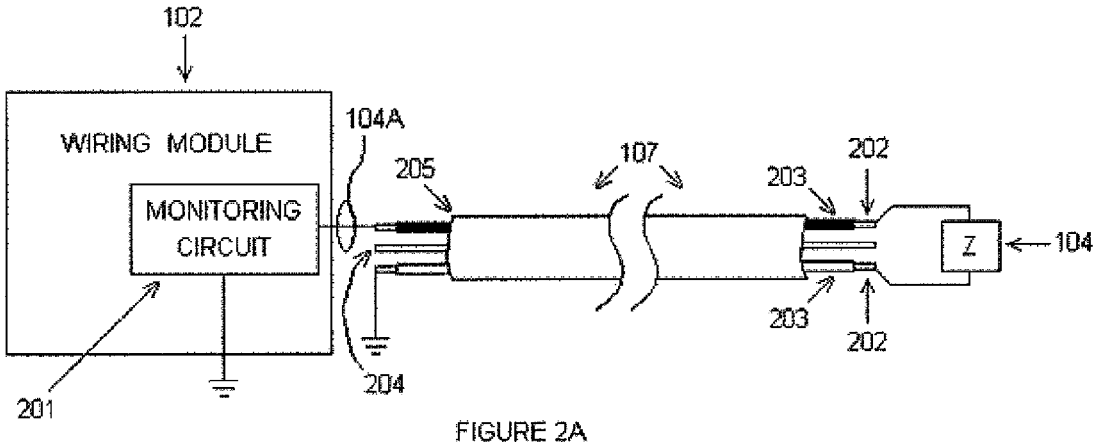
FIG. 2A is a functional schematic showing one method of connecting the wiring module to the protected system.

FIG. 2A depicts a connection embodiment using the controlled impedance device 104 to enable monitoring of electrical wiring 107 by a monitoring circuit 201. The wiring module 102 will contain one or more monitoring circuits 201. The monitoring circuit 201 shown here is a representation of any of the monitoring terminals of the wiring module 102. As depicted, typical electrical wiring 107 is constructed with at least two, but usually three conductors. Two of these conductors 202 are covered with insulation 203, and when in service are intended to carry the current load to and from the powered equipment. The third conductor 204 is not insulated and is intended to be used as a safety ground that only carries current when a fault condition exists. The three conductors are bundled together and covered with an insulating sheath 205.

As stated above, the electrical wiring 107 is not energized and is out of service when the system 100 is installed and the controlled impedance 104 is connected for monitoring purposes. The controlled impedance device 104 is connected between the two insulated conductors 202 at the far end of the protected electrical wiring 107. At the near end of the protected electrical wiring 107 one of the insulated conductors 202 will be connected to a dedicated monitoring circuit 201. The other near end insulated conductor 202 is connected to a common ground node (usually at the load distribution junction) or directly to the ground node of the monitoring circuit 201. The third conductor 204 is not used in this embodiment. When properly connected the impedance 104A presented to the monitoring circuit 201 will be equivalent to the controlled impedance 104, and the monitoring circuit 201 provides to a microprocessor within in the wiring module 102 an acceptable limit status signal for the presented impedance 104A.

The presented impedance 104A will exceed acceptable limits if an open circuit is created at any point along either of the two conductors 202. In such a case the monitoring circuit 201 provides to the microprocessor in the wiring module 102 an over range limit status for the presented impedance 104A. The presented impedance 104A will exceed acceptable limits if a short circuit condition is created at any point between the two conductors 202. In such a case the monitoring circuit 201 provides to the microprocessor in the wiring module 102 a short circuit limit status for the presented impedance 104A. If an attempt is made to bypass the controlled impedance 104 by connecting any other impedance across the two conductors 202 at the monitoring circuit 201 and then disconnecting the electrical wiring 107, the presented impedance 104A will exceed acceptable limits either when (a) the other impedance is connected creating an under range limit status or (b) the electrical wiring 107 is removed creating an over range limit status. This is true since any impedance that is within the acceptable limits of the controlled impedance 104 cannot present an impedance 104A that is within the acceptable limits when it is connected in parallel with the controlled impedance.

Figure 2B:
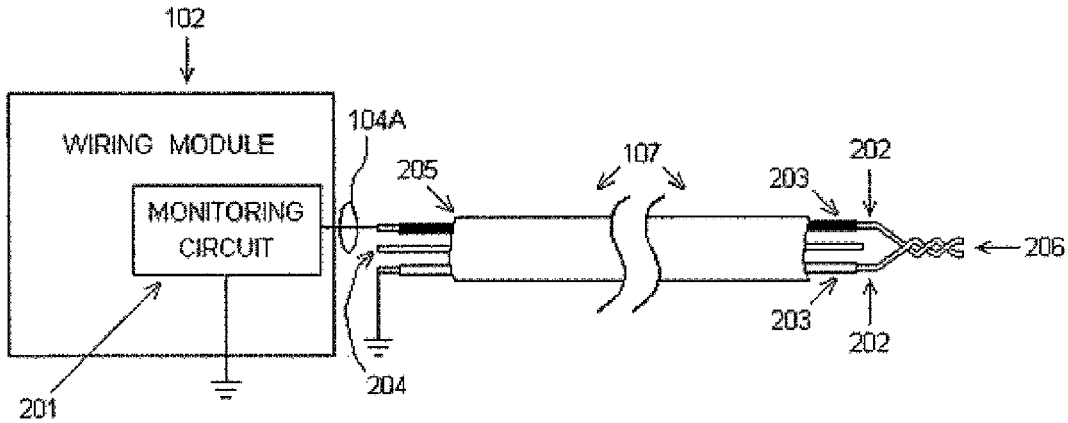
FIG. 2B is a functional schematic showing another method of connecting the wiring module to the protected system.

FIG. 2B depicts the same arrangement as in FIG. 2A without the use of the controlled impedance FIG. 2A 104. Here the two insulated conductors 202 are shown as being twisted together 206 at the far end forming a direct electrical connection. This could be considered the same as using a controlled impedance 104 with an impedance value of 0 Ohms. In such a case the monitoring circuit 201 provides to the microprocessor in the wiring module 102 a short circuit limit status of the presented impedance 104A. Should this method of protecting electrical wiring 107 be employed, then the tamper detection is limited and may be easily defeated. However, some protection would still be provided.

Figure 3:
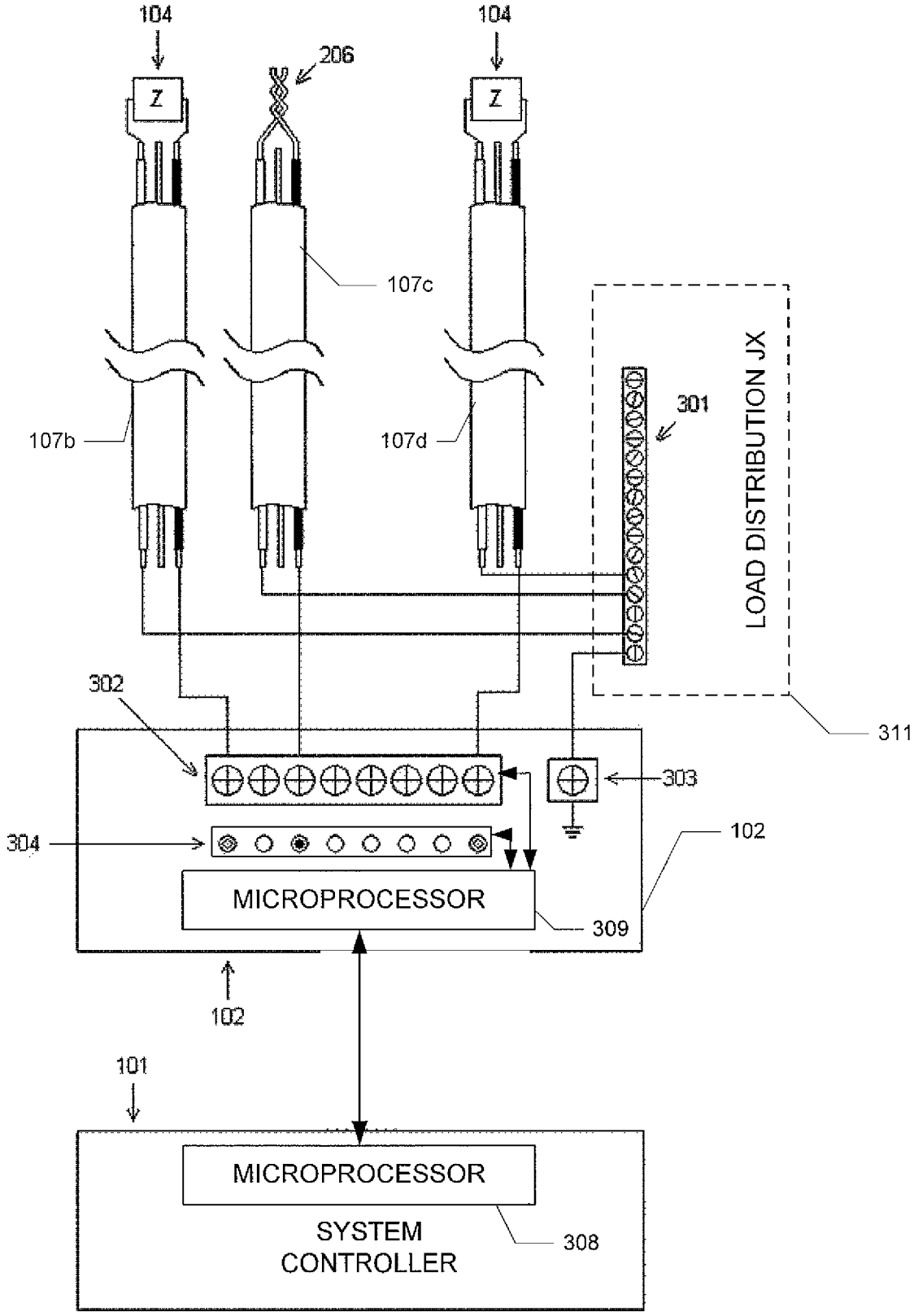
FIG. 3 is a wiring diagram of an embodiment of the exemplary security system of FIG. 1.

FIG. 3 depicts the system controller 101 interconnected to a wiring module 102. The wiring module 102 is connected to three lengths of electrical wiring 107*b-d*. Two sections of the electrical wiring 107*b*, 107*d* have controlled impedance devices 104 connected at the respective ends distal from the load distribution junction 311. The remaining section of electrical wiring 107*c* has the two insulated conductors twisted together 206 at the far end. Each section of the electrical wiring 107 has one near end insulated conductor connected to a unique monitor circuit terminal 302. The other near end insulated conductors are electrically interconnected by way of a neutral connector strip 301, as is found in a conventional load distribution junction 311. The neutral connector strip 301 is also connected to the monitor circuit ground terminal 303 thereby creating a circuit with the wiring module 102. As a result of user input relayed by the system controller 101 through the monitor circuit indicator LEDs 304 are illuminated to indicate the limit status of the corresponding monitoring circuits. Differentiation of the various limit status conditions can be achieved with the use of different colors, and or blinking of the monitor circuit indicator LEDs 304.

The primary function of the controlled impedance device 104 is to electrically terminate the far end of the electrical wiring 107 in such a manner that tampering that results in discontinuity, short circuit condition or a measurable impedance change across two conductors of the electrical wiring 107 may be easily detected by the wiring module 102. The impedance of the controlled impedance device 104 is selected such that the inherent resistance of the interconnecting electrical wiring 107 has only a negligible effect on the controlled impedance 104A presented to the wiring module 102. If the system 100 is installed to monitor a protected asset 108, then the controlled impedance device 104 is located on or within the protected asset 108 in such an arrangement that the controlled impedance 104A presented to the wiring module 102 will exceed acceptable limits if the protected asset 108 is removed. In such a case the interconnecting wiring 107 will be protected along with the protected asset 108.

The system controller 101 provides power to the wiring module 102 by way of the wiring module interconnect cable 105. The wiring module interconnect cable 105 carries bidirectional communications between the system controller 101 and the wiring module 102. Logic in the microprocessor 308 of the system controller 101 can detect the loss of communications with the wiring module should the wiring module interconnect cable 105 be tampered with or removed. Logic in microprocessors 309, 308 of the wiring module 102 and system controller 101 will store in memory the limit status of the monitoring circuit terminals 302 as a result of user input and can determine which monitoring circuit terminals 302 experience a change in limit status. Changes in limit status or tampering with the wiring module interconnect cable 105 can be indicated to the user or cause entry into an alarm state depending the current mode of operation of the system 100. Alarm state can be indicated by a variety of alert devices including, without limitation, a sound device 411, and lighting 413.

The system 100 shown in FIG. 1 also may include an optional, and desirable component, namely, a remote annunciator device 103 coupled to system controller 101 through separate wiring 107A which may be, for example, rough installed electrical wiring. The primary function of the remote annunciator device 103 is to provide a remote audible siren to deter theft and tampering activities with the electrical wiring 107 or protected assets 108. The remote annunciator 103 is interconnected to the system controller 101 by way of electrical wiring 107A previously installed on the premises. The remote annunciator device 103 is capable of receiving charge current from the system controller 101 by way of the interconnecting electrical wiring 107A. If more than one remote annunciator device 103 is used then each remote annunciator device 103 will be interconnected to the system controller 101 by way of a separate section of electrical wiring 107A. The remote annunciator device 103 is self powered and contains the logic necessary to communicate with the system controller 101 by way of the interconnecting electrical wiring 107A. The remote annunciator device 103 contains sensors and logic necessary to detect tampering that result in dismounting, enclosure intrusion or disruption of the interconnection to system controller 101.

With reference again to FIG. 4, the system controller 101 and the remote annunciator 103 are interconnected by way of electrical wiring 107A. The interconnection may be made using dedicated terminals 401 on the system controller 101 and dedicated terminals 402 on the remote annunciator 103. Preferably, the interconnection is made using all three conductors of the electrical wiring 107A previously installed on the premises.

Charging current is supplied from the system controller 101 to the remote annunciator 103 by way of the remote charge current control circuit 407 under control of the microprocessor 308. An over current protection fuse 406 is employed between the remote charge current control circuit 407 and the terminals 401 of the system controller 101. Bidirectional data is exchanged between the system controller 101 and remote annunciator 103 through an input/output buffer 410. The data clock is provided from the system controller 101 microprocessor 308 to the remote annunciator 103 by interrupting the remote charge current provided through the remote charge current control circuit 407.

The remote annunciator 103 provides redundancy in the system. The remote annunciator 103 contains many of the same components that are found in the system controller. A microprocessor 420 is configured with control logic to perform the functions described in greater detail below. Power for the microprocessor 420 and other devices is supplied by the power supply circuit 409. The remote annunciator 103 may also be self powered by a user replaceable rechargeable battery 403. Charging current may be provided through the charger connector 404 of the remote annunciator 103. When present, the charging current is supplied to the battery through a polarity protection diode 405 and an over current protection fuse 406. When the system is in use, charging current is supplied from the system controller 101 by way of the terminals 402 through a polarity protection diode 405A. The polarity protection diode 405A prevents the system controller 101 from drawing power from the remote annunciator 103. Bidirectional data is exchanged between the remote annunciator 103 and system controller 101 through an input/output buffer 410. The data clock is provided to the remote annunciator 103 microprocessor 420 from the system controller 101 through the opto-isolator 416. The remote annunciator 103 provides an audible siren device 411 that is controlled by the microprocessor 420 through a siren driver circuit 412. Tamper circuitry 417 is connected to the microprocessor 420 provided in the remote annunciator 103 to detect unauthorized dismounting or opening of the remote annunciator 103 enclosure.

Figure 5:
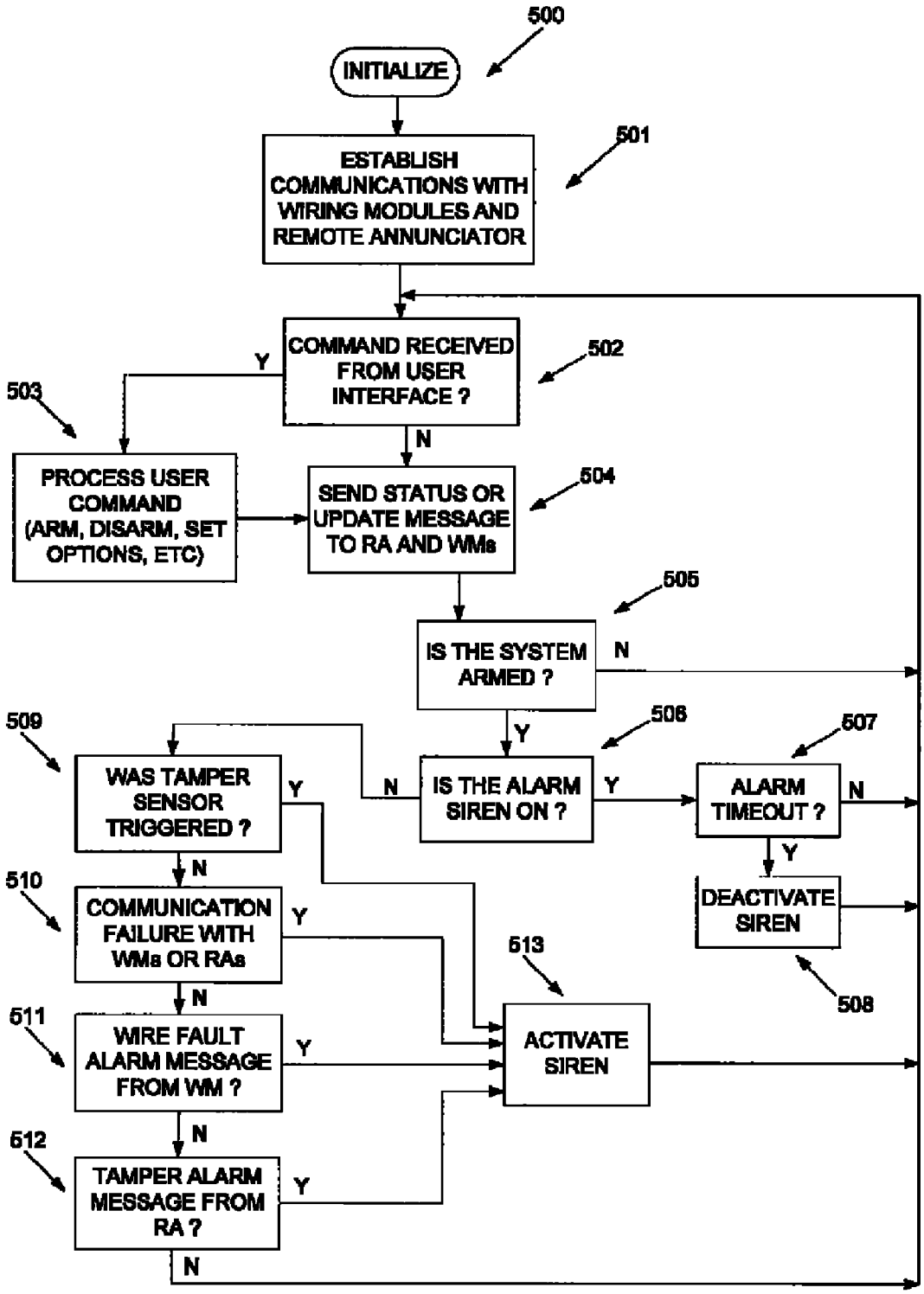
FIG. 5 is a flow diagram of an exemplary process executed by a system controller.

The flowchart in FIG. 5 shows an example of control logic for a processor implementing the control method of a system controller 101. The processor establishes communications with the wiring module(s) 102 and the remote annunciator(s) 103 (if present)501. Next, the processor determines if a command was received from the user interface 502. If a command was received then control goes to 503. If a command was not received then control goes to 504. At step 503, the system processes user command and modifies the status of the system controller 101 as necessary. At step 504, it sends status or updates messages to remote annunciator(s) 103 and wiring modules 102. Next, the system determines if the system 100 is an armed state 505. If the system 100 is in an armed state then control goes to 506. If the system 100 is not in an armed state then control goes to 502. At step 506, the system determines if the alarm siren 411 is on. If the system 100 is in an alarm state then control goes to 507. If the system 100 is not in an alarm state then control goes to 509. At step 507, it determines if the alarm timeout has expired. If the alarm timeout has expired then control goes to 508. If the alarm timeout has not expired then control goes to 502. At step 508, the alarm siren 411 is deactivated and control returns to 502. If the alarm is not on, the system determines if a tamper sensor 417 has been triggered 509. If a tamper sensor 417 has been triggered then control goes to 513. If no tamper sensors have been triggered then control goes to 510. At step 510, it determines if communications has been lost with the wiring module(s) 102 or the remote annunciator(s) 103. If any communications have been lost then control goes to 513. If communications are intact then control goes to 511. At step 511, it determines if a wire fault message has been received from a wiring module 102. If a wire fault message has been received then control goes to 513. If a wire fault message was not received then control returns to 512. At step 512, it determines if a tamper alarm message has been received from a remote annunciator 103. If a tamper message has been received then control goes to 513. If a tamper message was not received then control returns to 502. At step 513, the system commands to activate the alarm siren 411, reset alarm timeout, and return control to 502.

Figure 6:
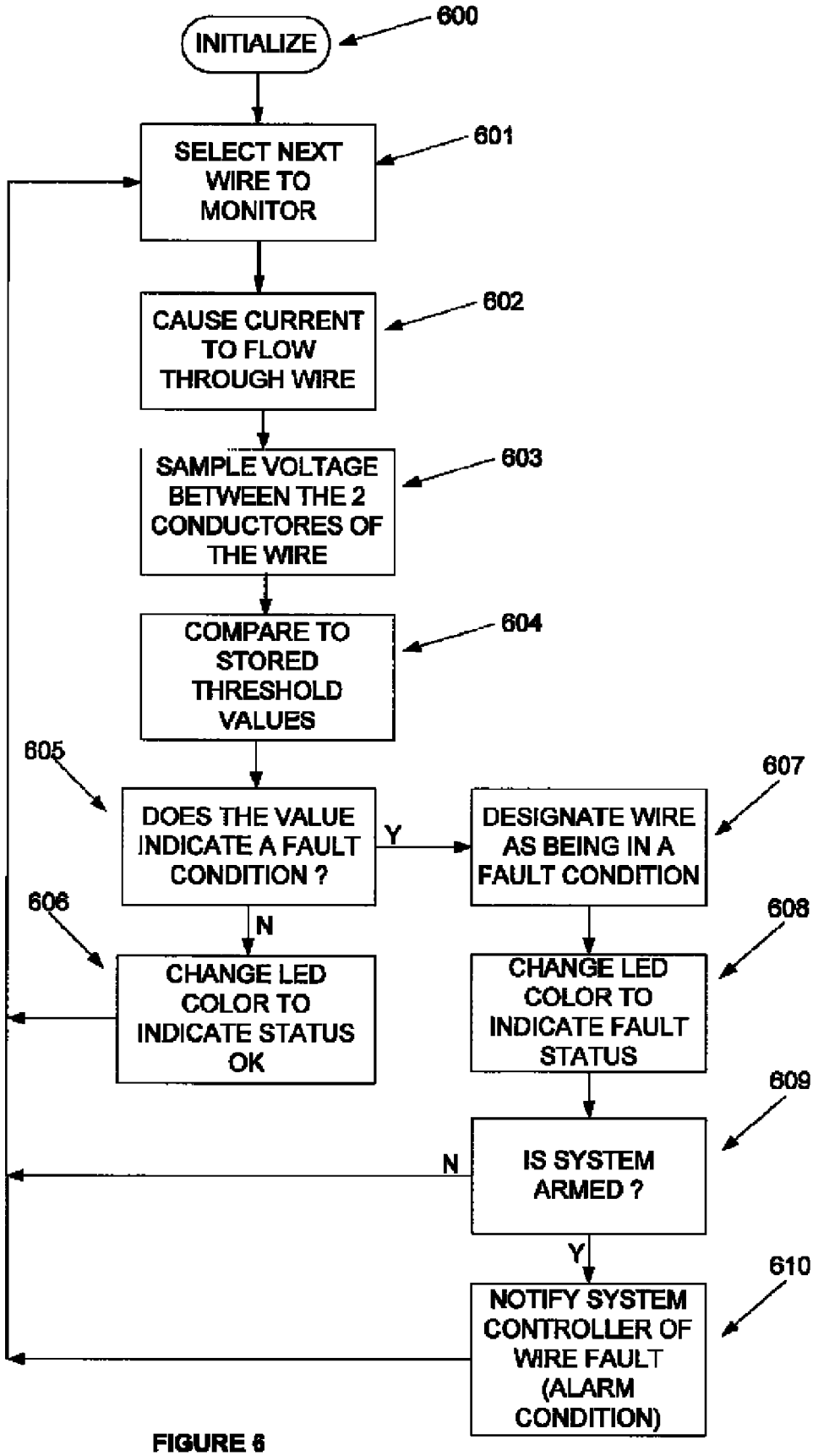
FIG. 6 is a flow diagram of an exemplary process executed by a wiring module.

The flowchart in FIG. 6 shows an embodiment of control logic for a processor implementing the control method of a wiring module 102. First, the processor selects which monitoring circuit 201 to monitor 601. Next, the processor causes current to flow from the selected monitoring circuit 201 through the controlled impedance 104 by way of the conductors 202 of the interconnected electrical wiring 107 (602). Then, the voltage across the presented impedance 104A of the selected monitoring circuit 201 is sampled 603 and the sampled voltage is compared to stored threshold values in order to determine if the value is within acceptable limits 604. At step 605, a decision is made on the fault status of the sampled value. If a fault condition is not chosen then control goes to step 606. If a fault condition is chosen then control goes to step 607. At step 606, the LED 304 corresponding to the selected monitoring circuit 201 is set to indicate an acceptable status and control returns to 601. At step 607, however, the electrical wire 107 connected to the selected monitoring circuit 201 is designated as being in a fault condition. In such case, the LED 304 corresponding to the selected monitoring circuit 201 is set to indicate a fault status 608. Then, the processor determines if the system 100 is in an armed state 609. If the system 100 is in an armed state then control goes to 610 in which case, the system controller 101 is notified by communications over the interconnecting cable 105 of an alarm condition (610) and control returns to 601. On the other hand, if the system 100 is not in an armed state then control returns to 601.

Figure 7:
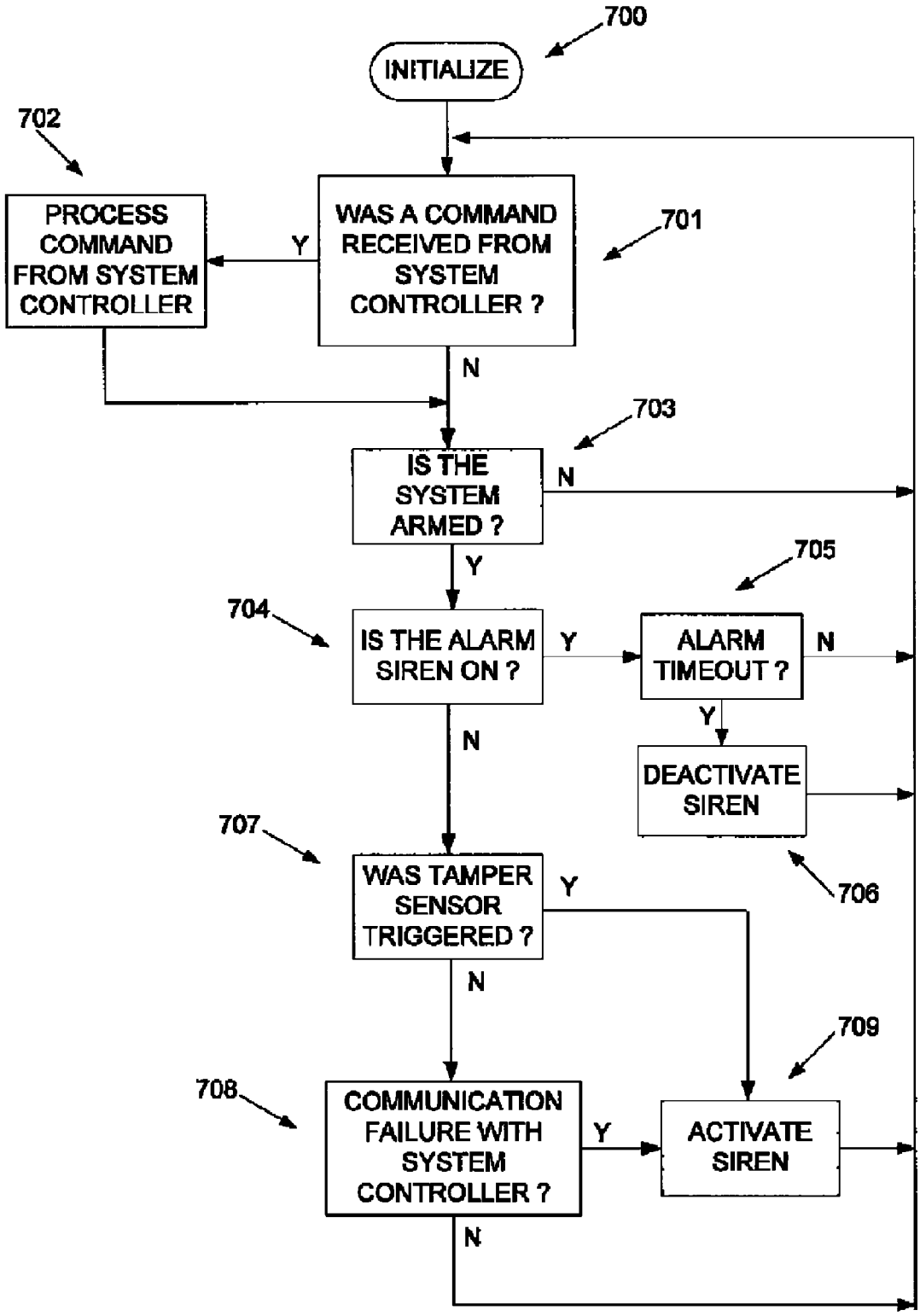
FIG. 7 is a flow diagram of an exemplary process executed by an optional remote anunciator.

The flowchart in FIG. 7 shows an embodiment of control logic for a processor implementing the control method of a remote annunciator 103. First, the system determines if a command has been received from the system controller 101 (701). If a command was received then control goes to 702. If a command was not received then control goes to 703. At step 702, the remote annunciator processes the command from system controller 101 and modifies the status of the remote annunciator 103 as necessary. Next, it determines if the system 100 is in an armed state 703. If the system 100 is in an armed state then control goes to 704. If the system 100 is not in an armed state then control returns to 701. At step 704, the remote annunciator determines if the alarm siren 411 is on. If the alarm siren 411 is on, the control goes to 705. If the alarm siren 411 is not on then control goes to 707. At step 705, the remote annunciator determines if the alarm timeout has expired. If the alarm timeout has expired then control goes to 706. If the alarm timeout has not expired then control returns to 701. At step 706, the remote annunciator deactivates the alarm siren 411 and returns control to 701. At step 707, it determines if a tamper sensor 417 was triggered. If a tamper sensor 417 was triggered then control goes to 709. If no tamper sensors 417 have been triggered then control goes to 708. At step 708, the remote annunciator determines if communications have been lost with the system controller 101. If any communications have been lost then control goes to 709. If communications are intact then control returns to 701. At step 709, the remote annunciator activates alarm siren 411, resets alarm timeout, and returns control to 701.

Many of the functions of the above-described apparatus may be implemented with logic circuitry as would be understood by those skilled in the relevant arts. Those functions may also be controlled or executed by one or more processors. A processor, or microprocessor, can be implemented by a field programmable gated array (FPGA), a central processing unit (CPU) with a memory, or other logic device.

The processor in effect comprises a computer system. Such a computer system includes, for example, one or more processors that are connected to a communication bus. The computer system can also include a main memory, preferably a random access memory (RAM), and can also include a secondary memory. The secondary memory can include, for example, a hard disk drive and/or a removable storage drive. The removable storage drive reads from and/or writes to a removable storage unit in a well-known manner. The removable storage unit, represents a floppy disk, magnetic tape, optical disk, and the like, which is read by and written to by the removable storage drive. The removable storage unit includes a computer usable storage medium having stored therein computer software and/or data.

The secondary memory can include other similar means for allowing computer programs or other instructions to be loaded into the computer system. Such means can include, for example, a removable storage unit and an interface. Examples of such can include a program cartridge and cartridge interface (such as that found in video game devices), a removable memory chip (such as an EPROM, or PROM) and associated socket, and other removable storage units and interfaces which allow software and data to be transferred from the removable storage unit to the computer system.

Computer programs (also called control logic) are stored on computer-readable media in the main memory and/or secondary memory. Computer programs can also be received via a communications interface. Such computer programs, when executed, enable the computer system to perform certain features of the present invention as discussed herein. In particular, the computer programs, when executed, enable a control processor to perform and/or cause the performance of features of the present invention. Accordingly, such computer programs represent controllers of the computer system of security system.

In an embodiment where the invention is implemented using software, the software can be stored in a computer program product and loaded into the computer system using the removable storage drive, the memory chips or the communications interface. The control logic (software), when executed by a control processor, causes the control processor to perform certain functions of the invention as described herein.

In another embodiment, features of the invention are implemented primarily in hardware using, for example, hardware components such as application specific integrated circuits (ASICs) or field-programmable gated arrays (FPGAs). Implementation of the hardware state machine so as to perform the functions described herein will be apparent to persons skilled in the relevant art(s). In yet another embodiment, features of the invention can be implemented using a combination of both hardware and software.

As described above and shown in the associated drawings, the present invention comprises a security system for protecting construction site assets. While particular embodiments of the invention have been described, it will be understood, however, that the invention is not limited thereto, since modifications may be made by those skilled in the art, particularly in light of the foregoing teachings. It is, therefore, contemplated by the following claims to cover any such modifications that incorporate those features or those improvements that embody the spirit and scope of the present invention.

What is claimed is:

1. An apparatus comprising:

a. a controller;

b. a wiring module responsive to said controller and comprising at least one monitoring circuit coupled to at least one length of unpowered electrical wiring, the at least one length of electrical wiring having at least two conductors, each of the at least two conductors having a near end that is installed at an unpowered load distribution junction in a building, and a far end that is electrically coupled to the far end of the other conductor with a controlled impedance device having a randomly selected impedance, and wherein said at least one monitoring circuit is coupled to the near ends of said at least two conductors thereby forming a monitored circuit;

c. a user interface in communication with said controller; and d. an alert device responsive to said controller; and e. wherein said apparatus is configured with control logic to issue an alert if the integrity of the monitored circuit has been compromised determined by comparing a presented impedance to a stored impedance, said stored impedance corresponding to said randomly selected impedance.

2. The apparatus of claim 1, wherein said far ends are electrically coupled with a protected asset interposed therebetween, said protected asset being at least one of uninstalled bulk wiring, an electric motor, and an appliance.

3. The apparatus of claim 1, further comprising a remote annunciator device in communication with said controller, and coupled thereto with a second length of said unpowered electrical wiring, and comprising a second alert device.

4. The apparatus of claim 3, wherein said remote annunciator further comprises a tamper detector for detecting whether said remote annunciator has been uninstalled, and wherein said remote annunciator is configured with control logic to issue an alert when said remote annunciator is no longer in communication with said controller.

5. The apparatus of claim 3, wherein said second length of electrical wiring comprises three conductors, and wherein said remote annunciator is coupled to said controller via said three conductors.

6. The apparatus of claim 5, wherein said remote annunciator further comprises a tamper detector for detecting whether said remote annunciator has been uninstalled, said tamper detector being responsive to said controller.

7. The apparatus of claim 5, wherein said far ends are electrically coupled with a protected asset interposed therebetween, said protected asset being at least one of uninstalled bulk wiring, an electric motor, and an appliance.

8. The apparatus of claim 7, wherein said remote annunciator further comprises a tamper detector for detecting whether said remote annunciator has been uninstalled, said tamper detector being responsive to said controller.

9. A system for detecting removal of rough-installed and unpowered electrical wiring, the unpowered electrical wiring having at least two conductors, each of said at least two conductors having first and second ends, the first ends thereof located at a load distribution junction in a building, the system comprising:

a. one or more wiring modules coupled to the first ends of one or more lengths of said rough-installed electrical wiring;

b. one or more controlled impedance devices, each said device having a randomly selected impedance, electrically coupling the second ends and disposed at locations in the building distant from the junction, forming one or more circuits; and c. a self-powered control device in communication with said one or more wiring modules, and having a user interface, an aural alert device, a visual alert device, and configured with control logic to issue an alert if a presented impedance varies from said randomly selected impedance.

10. The system of claim 9, wherein a protected asset is interposed between the respective second ends of said at least two conductors, said protected asset being at least one of uninstalled bulk wiring, an electric motor, and an appliance.

11. The system of claim 9, further comprising a self-powered remote annunciator in communication with said control device via a length of said unpowered electrical wiring, said remote annunciator comprising an alarm and a tamper detector for detecting whether said remote annunciator has been uninstalled, and wherein said remote annunciator is configured with control logic to activate said alarm when said remote annunciator is no longer in communication with said control device.

12. The system of claim 11, wherein a protected asset is interposed between the respective first and second ends of said at least two conductors, said protected asset being at least one of uninstalled bulk wiring, an electric motor, and an appliance.

13. An apparatus for deterring removal of unpowered electrical wiring that is rough-installed in a building, the electrical wiring having three conductors, where two of said conductors have first and second ends, the first ends thereof located at a load distribution junction in the building that is not connected to an external power source, the apparatus comprising:

a. one or more wiring modules coupled to the first ends of said two conductors of one or more lengths of said unpowered electrical wiring;

b. one or more controlled impedance devices, each having a randomly selected impedance, coupling corresponding second ends of said unpowered electrical wiring disposed at locations in the building distant from the junction thereby forming one or more circuits with said one or more wiring modules, and wherein said wiring module is configured to detect a presented impedance;

c. a self-powered control device in communication with said one or more wiring modules, and having a user interface, an aural alert device, a visual alert device, and configured with control logic to issue an alert if said presented impedance differs from said randomly selected impedance; and d. at least one self-powered remote annunciator in communication with said control device via three conductors of a separate length of said unpowered electrical wiring, said at least one remote annunciator comprising a tamper detector for detecting whether said at least one remote annunciator has been uninstalled and an alarm, and wherein said at least one remote annunciator is configured with control logic to activate said alarm when said at least one remote annunciator is no longer in communication with said control device.

14. The apparatus of claim 13, wherein said presented impedance is greater than 0 Ohms.

* * * * *